US005378085A

United States Patent [19]

Kono et al.

[11] Patent Number: 5,378,085

[45] Date of Patent: Jan. 3, 1995

[54] METHODS FOR IN SITU CONSTRUCTION OF DEEP SOIL-CEMENT STRUCTURES

[75] Inventors: Ikuo Kono, Tokyo, Japan; David S. Yang, Fremont, Calif.

[73] Assignee: S. M. W. Seiko, Hayward, Calif.

[21] Appl. No.: 130,626

[22] Filed: Oct. 1, 1993

[51] Int. Cl.[6] ..... E02D 5/46

[52] U.S. Cl. ..... 405/233; 405/240; 405/241; 405/267

[58] Field of Search ..... 405/233, 236, 240, 241, 405/248, 266, 267, 269

[56] References Cited

U.S. PATENT DOCUMENTS

| | | | |
|---|---|---|---|
| 3,938,344 | 2/1976 | Asayama | 405/248 X |
| 4,496,011 | 1/1985 | Mazo et al. | 405/240 X |
| 4,533,279 | 8/1985 | van den Elzen et al. | 405/233 X |
| 4,566,825 | 1/1986 | Hirai et al. | 405/267 |
| 4,662,792 | 5/1987 | Gessay | 405/233 |
| 4,793,740 | 12/1988 | Schellhorn | 405/248 X |
| 4,886,400 | 12/1989 | Taki et al. | 405/267 |
| 4,906,142 | 3/1990 | Taki et al. | 405/267 |
| 4,909,675 | 3/1990 | Taki | 405/267 |
| 5,007,770 | 4/1991 | Simmons et al. | 405/240 |
| 5,013,185 | 5/1991 | Taki | 405/128 |
| 5,047,086 | 9/1991 | Hayakawa et al. | 106/731 |
| 5,118,223 | 6/1992 | Taki | 405/267 |
| 5,304,016 | 4/1994 | Kunito | 405/233 |

FOREIGN PATENT DOCUMENTS

| | | | |
|---|---|---|---|
| 111918 | 4/1989 | Japan | 405/233 |

*Primary Examiner*—Dennis L. Taylor
*Assistant Examiner*—John A. Ricci
*Attorney, Agent, or Firm*—Workman, Nydegger & Jensen

[57] ABSTRACT

Methods are provided for the constructing of subterranean soil-cement structures in situ. The methods utilize techniques designed to prolong the period of time in which an auger machine can operate in a bore hole without encountering difficulty due to the hardening of the soil-cement mixture. The techniques utilized include a preparatory drilling phase during which a lubricating slurry may be injected. This preparatory drilling serves to break up the soil and particularly if a lubricating slurry is used, reduce friction so that final drilling may progress more quickly. After preparatory drilling, final drilling takes place. Final drilling is divided into a downward and an upward phase. Either hardening or non-hardening slurry may be introduced and consolidated with the soil during the downward phase, but only hardening slurry is typically utilized during the upward phase of final drilling. These techniques result in a quicker and more homogeneous mixture of slurry and soil and allow the bore hole to be deeper.

12 Claims, 3 Drawing Sheets

METHODS FOR IN SITU CONSTRUCTION OF DEEP SOIL-CEMENT STRUCTURES

BACKGROUND

1. Field of the Invention

The present invention relates to methods for mixing soil with a chemical hardener in situ to form soil-cement columns, walls, piles, grids and monolithic overlapping columns. More particularly, the present invention is directed to improved methods for introducing various and consolidating slurries with soil to form deep soil-cement columns, walls, piles, grids, and monolithic blocks of columns.

2. Relevant Technology

For a number of years, multi-shaft auger machines have been used to construct soil-cement columns in the ground without having to excavate and remove the soil. These columns are sometimes referred to as "soilcrete" columns, because the soil is mixed with a cement slurry in situ. Upon hardening, the soil-cement columns possess some characteristics of lower strength concrete columns, but they are constructed without the expense and time-consuming process of removing and replacing the soil with concrete.

Soil-cement columns have been arranged in a variety of patterns depending on the desired application. Some soil-cement columns are used to improve the load bearing capacity of soft soils, such as sandy or soft clay soils. The columns are formed in the ground to help support surface construction.

In other cases, the soil-cement columns have been overlapped to form boundary walls, excavation support walls, low to medium capacity soil-mixed caissons, and for the in situ fixation of contaminated soil or toxic waste.

Because the soil is mixed in situ and because the soil-cement wall is formed in a single process, the construction period is shorter than for other construction methods. The costs of forming soil-cement columns are less than traditional methods requiring excavation of the soil, construction of forms, and the pouring of concrete into the forms in order to form the concrete columns or walls. In addition, because the soil is not actually removed from the bore hole in the process of forming the soil-cement structures, there is comparatively less material brought to the surface which must be disposed of during the course of construction.

Historically, a modified earth digging auger machine is used in the formation of in situ soil-cement columns. Such an auger machine is depicted in FIG. 1. The final boring and mixing operations are performed by multi-shaft drive units in order to make the process more efficient. A shaft typically has attached thereto soil mixing paddles 18 and auger blades 20 which horizontally and vertically consolidate the soil with a chemical hardener to produce columns having a homogeneous mixture of soil and chemical hardener.

As auger blades 20 located at the lower end of each shaft 10 of a multi-shaft drive unit penetrate the soil, the soil is fractured and a chemical hardener slurry is injected into the soil through the ends of the hollow-stemmed augers which are attached to the shaft or through opening 11 in the shaft. The augers penetrate, fracture and lift the soil to mixing paddles which further consolidate the slurry in the soil.

To produce soil-cement columns, a multi-shaft auger machine bores into the ground and simultaneously mixes the soil with a slurry of chemical hardener pumped from the surface through the auger shaft to the end of the auger. The resulting soil and slurry mixture is often referred to as a bore hole. The use of the term "bore hole" does not necessarily mean that soil is removed to create a hole. Although some soil is deposited on the surface due in part to expansion of the soil as it is fragmented and consolidated with the slurry, the majority of the soil remains below the surface as it is mixed.

Multiple columns are prepared while the soil-cement mixture or soil-chemical mixture is still soft. By overlapping the columns at the end of the series of columns, a continuous wall may be formed. This is accomplished by drilling through a portion of the end column of the previous series of columns before that column has hardened. As the auger drills through the soil, the chemical hardener slurry is injected into the fractured soil. This slurry acts as a lubricant and begins the chemical reaction which results in the hardening of the soil-cement columns. Because the auger apparatus must be capable of drilling downward into a bore hole and injecting the chemical hardener slurry, and then must be able to drill back up before the soil-cement column hardens, there is a temporal limit to the depth of a bore hole.

Not only must the auger be removed from the bore hole before hardening of the soil-cement column but the auger must be capable of redrilling through a portion of the last column to form overlapping columns or walls. If the soil is hard or the bore hole is deep, valuable time may be lost in drilling the bore hole and the soil-cement column may harden before the next bore hole is formed.

Traditionally, the mixture of the chemical hardener slurry and the soil is such that it may set up shortly after the slurry is injected. While use of such a method and mixture creates little trouble in many circumstances, certain conditions exist which can result in significant problems due to the untimely hardening of the soil-cement mixture. These conditions include construction of soil-cement structures at greater depths, construction of soil-cement structures in hard soil, and equipment breakdown. Under these conditions, the soil-cement mixture may harden before the soil-cement column is complete which can have a number of detrimental effects including inferior quality soil-cement structures, abandonment of a partially completed soil-cement column, damage to the auger apparatus, or even loss of the auger apparatus due to the hardening of the soil-cement structure while the auger apparatus is still in the bore hole.

OBJECT AND BRIEF SUMMARY OF THE INVENTION

It is, therefore, an object of the present invention to provide a method to prolong the period during which the auger may be operated in the bore hole prior to hardening of the soil-cement structure.

Another object of the present invention is to provide a method for achieving thorough mixing of the chemical hardener slurry and soil such that a more homogenous mixture is achieved.

A further object of the present invention is to provide a method for the construction of deep soil-cement structures.

A still further object of the present invention is to provide a method for the construction of deep soil-cement structures in hard ground.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein methods are provided in which a lubricating nonhardening slurry and a hardening slurry are introduced and consolidated into a bore hole.

Historically, construction of soil-cement structures in situ has been limited to shallow areas of relatively soft soil because attempts to construct deep soil-cement structures or to construct soil-cement structures in hard soil resulted in hardening or partial hardening of the soil-cement mixture before the auger could be removed. To overcome the difficulties presented by untimely hardening of the soil-cement mixture, the present invention utilizes methods employing techniques designed to prolong the period of time that the auger can operate and a slurry can be injected before the soil-cement structure hardens and affects the operation of the auger.

One technique which may be employed is that of adding an additional downward and upward drilling phase to the soil-cement structure construction process. This "preparatory drilling" or "predrilling" involves breaking up or fracturing the soil prior to the final drilling process. Predrilling may be accomplished dry or may utilize a slurry having lubricating properties having a very slow hardening process or not having a chemical hardening agent present to begin the hardening process.

The soil and lubricating non-hardening slurry, if used, may include aggregate, clay and liquid. In a presently preferred embodiment of the present invention, the lubricating slurry includes slag, Dentonite, and water.

The hardening slurry may include a chemical hardener, clay and liquid. In a presently preferred embodiment of the present invention, the hardening slurry includes cementitious material, bentonite and water.

These techniques and slurries are employed in various combinations to provide methods which prolong the period of time in which the auger can operate without encountering difficulty due to the hardening of the soil-cement mixture. In addition, these techniques allow for a more homogenous mixture of soil and slurry which improves the strength properties of the soil-cement structure.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
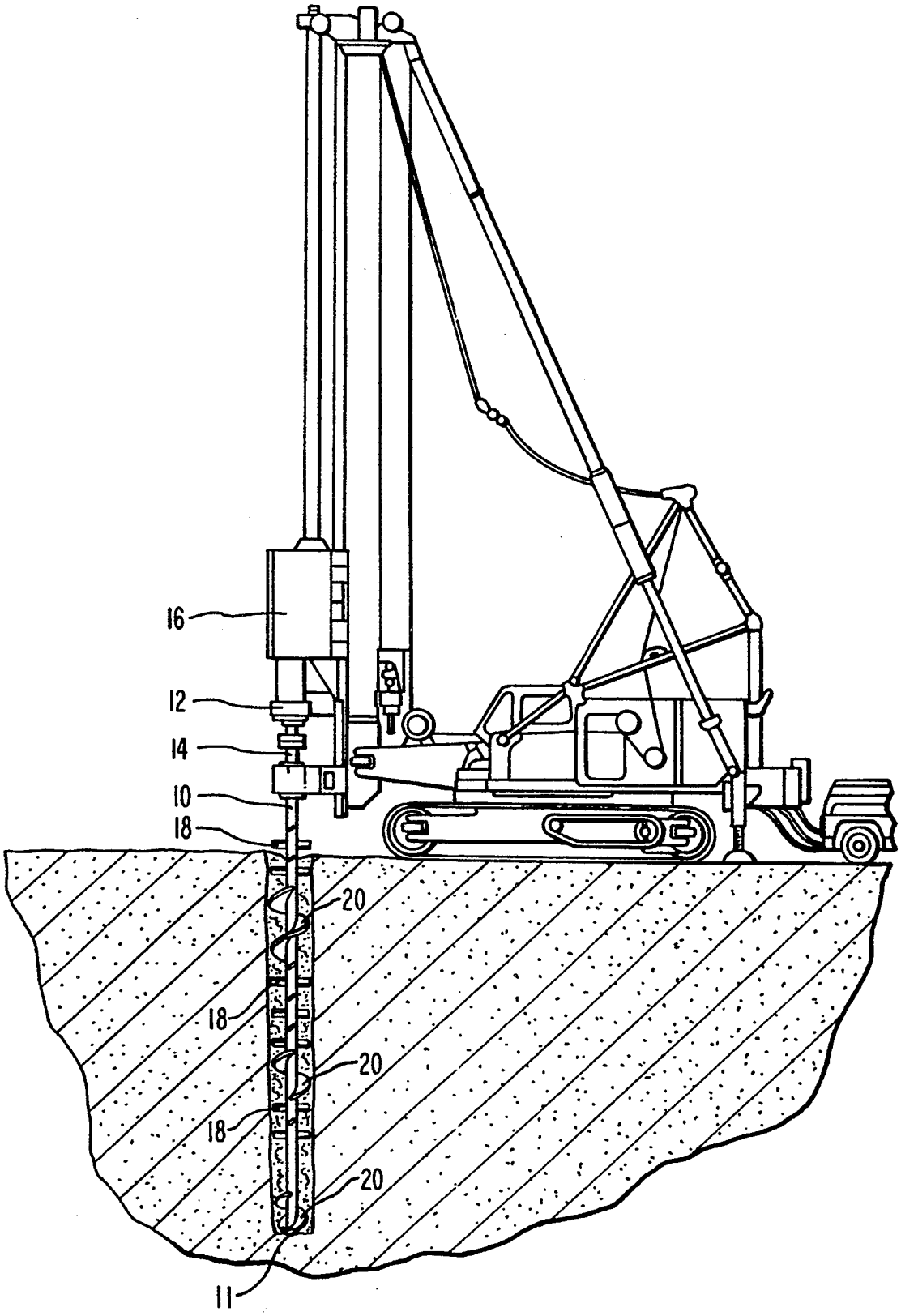
FIG. 1 (PRIOR ART)
FIG. 1 is a cross-sectional view illustrating the environment in which auger shafts operate.

Reference is now made to the drawings wherein like parts are designated with like numerals throughout. Referring initially to FIG. 1, a prior art multi-shaft auger machine is illustrated as the machine would appear in operation.

Each shaft of the multi-shaft auger machine, shown generically as shaft 10, is attached to a gearbox 12 at an upper end 14. A motor 16 transfers power through gearbox 12 to each shaft. Spaced throughout the length of each shaft are intermittent soil mixing paddles 18 and auger blades 20. Auger shaft 10, auger blades 20 and mixing paddles 18 are collectively referred to as the "auger."

The auger blades 20 fracture the soil and vertically mix the soil with a slurry which is injected into the soil surrounding the shafts. The slurry is typically injected from the end 11 of shaft 10 although other points of injection also are possible. The soil mixing paddles 18 further assist to break up the soil and homogeneously mix the soil with the chemical hardener.

A. Preparatory Drilling

Figure 2:
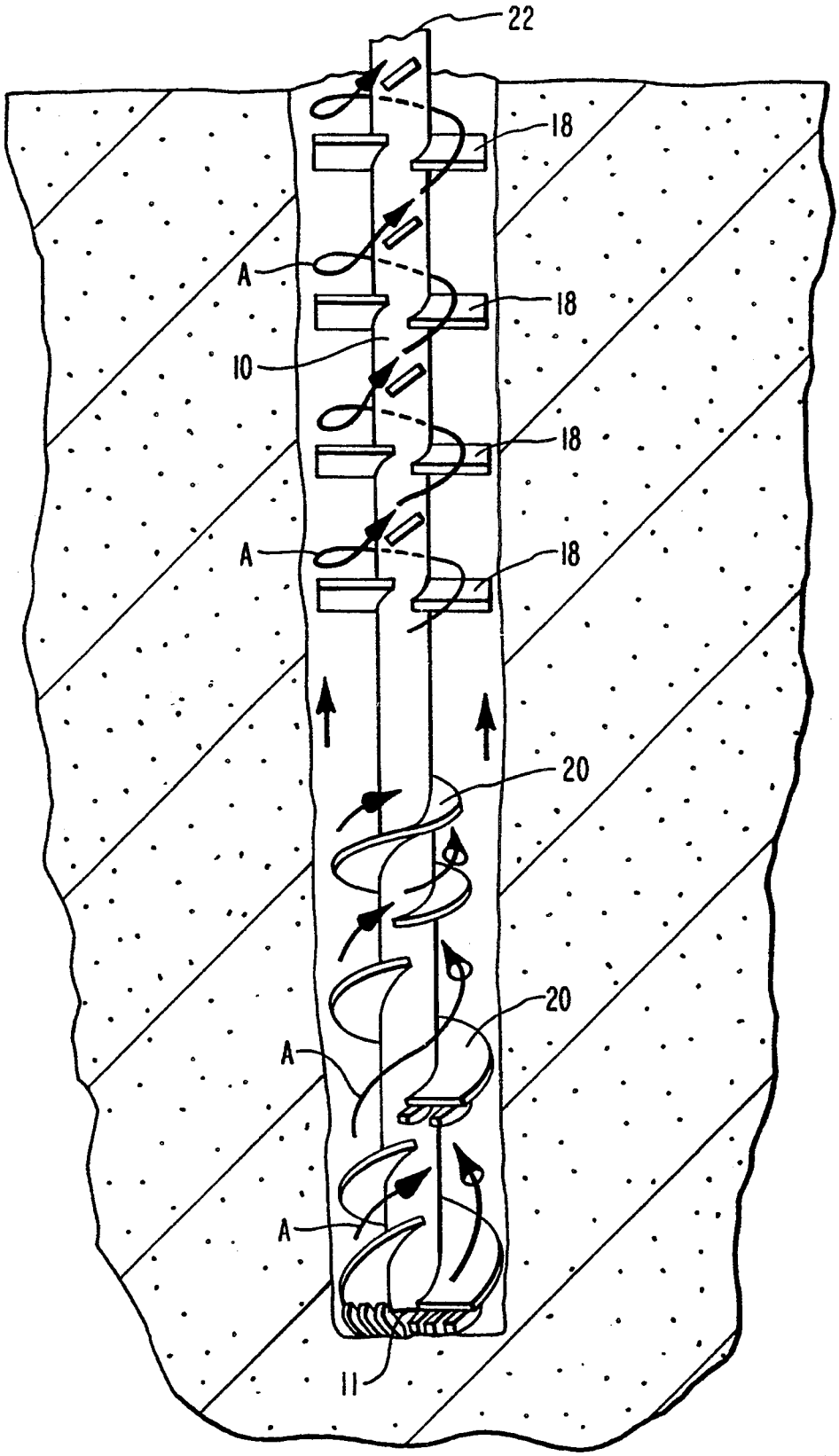
FIG. 2 is a cross-sectional view illustrating downward preparatory drilling with a single shaft auger.

FIG. 2 illustrates one example of the equipment utilized in preparatory drilling. Downward drilling is shown by motion lines "A." This single shaft auger machine is exemplary of preparatory drilling equipment but it will be appreciated that preparatory drilling could also be accomplished with a multi-shaft auger machine. As used in this specification, the term "preparatory drilling" or "predrilling" is defined as drilling during no hardener slurry is utilized in either downward or upward drilling.

Although a temporal limit is set by the hardening of the chemical hardener after introduction to the soil, another physical limit is reached when the auger apparatus is no longer able to rotate the auger shaft. This occurs when the bore hole is deep or the soil very hard or rocky. The resistance produced by the consolidation of hard soil or the shear volume of soil in a deep bore hole imposes a torsional limit on the auger machine.

To increase the level of the torsional limit, "predrilling" or "preparatory drilling" may be utilized. Predrilling is typically accomplished with a single shaft auger machine. A bore hole is drilled to the desired depth as in final drilling but with only one auger shaft, more power is available to fracture hard soil or to propel the shaft deeper. After predrilling is completed, less energy is required during the final drilling process resulting in the ability to create soil-cement columns at depths previously unattainable. This also allows more energy to be used to more thoroughly mix the soil.

A lubricating slurry may be used during the preparatory drilling phase. Such a slurry is consolidated with soil by soil mixing paddles 18 and auger blades 20. If a lubricating slurry is to be used during the downward phase of preparatory drilling, the lubricating slurry will be injected through the auger and consolidated into the soil.

Upward preparatory drilling is accomplished in a similar manner with the direction of movement of the augers being reversed. If a lubricating slurry is to be used during the upward phase of preparatory drilling, the lubricating slurry can be injected through the auger as the auger is withdrawn.

There are numerous variations of preparatory drilling which serve to accomplish the same purpose. By way of example and not limitation, the soil might simply be fractured during downward and upward preparatory drilling. Alternatively, the soil might be fractured during downward preparatory drilling and consolidated with a lubricating slurry during upward preparatory drilling.

Another example would be to consolidate the soil with a lubricating slurry during both downward and upward preparatory drilling.

A still further example would be to consolidate the soil with a lubricating slurry during downward preparatory drilling and fracture the soil during upward preparatory drilling. The most advantageous technique will typically depend on the soil conditions.

In a presently preferred embodiment the lubricating slurry includes, slag, bentonite and water. By way of example and not by limitation, the following slurry may be used for lubricating. In coarse sand, sandy gravel, or soft rock: 100–200 kilograms of slag, 20–30 kilograms of bentonite and 500–600 kilograms of water.

B. Final Drilling

Figure 3:
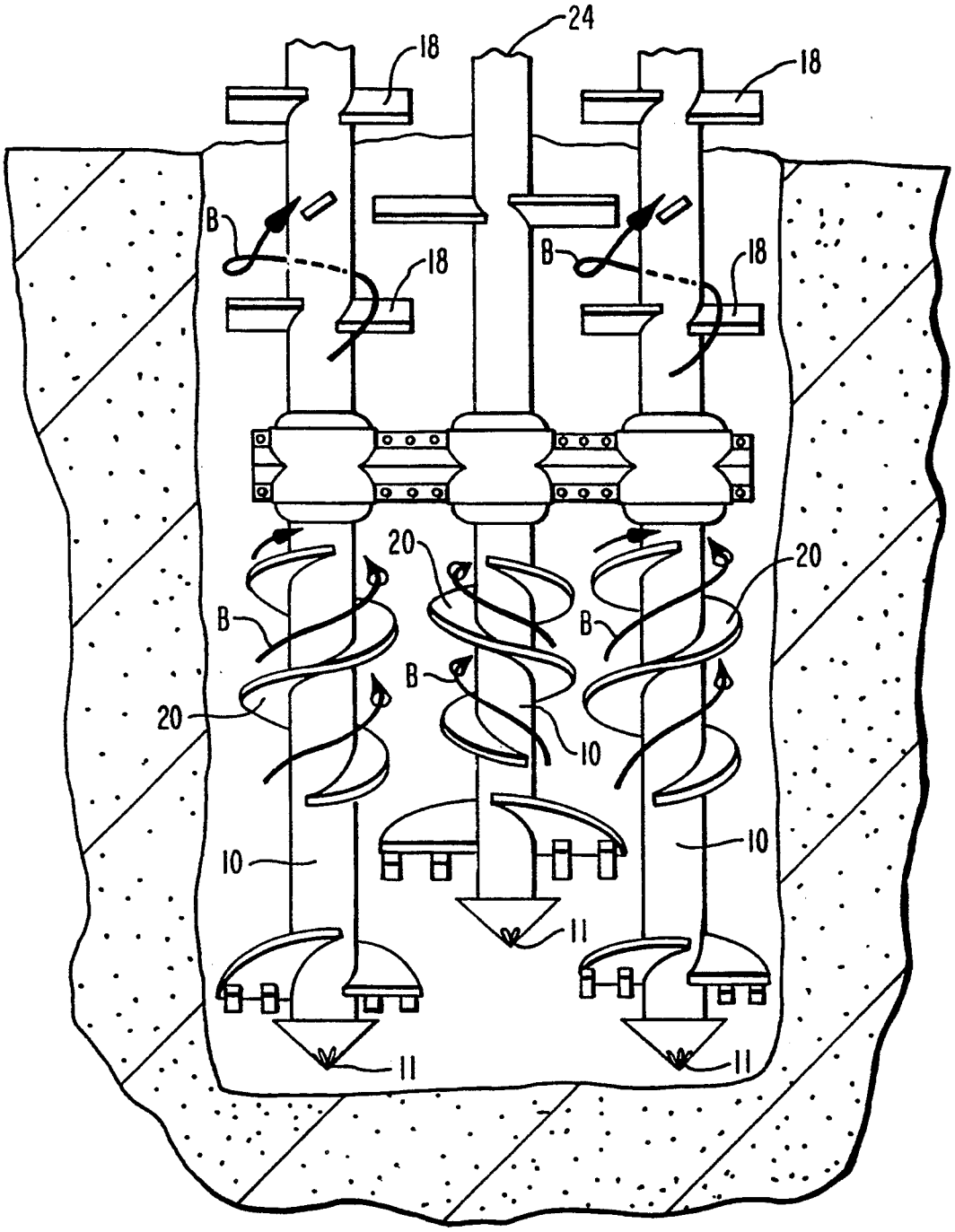
FIG. 3 is a cross-sectional view illustrating final downward drilling with a multi-shaft auger apparatus.

FIG. 3 illustrates downward final drilling, as shown by motion lines B, utilizing a multi-shaft auger machine 24. It will be appreciated that final drilling may also be accomplished using a single shaft auger, but it will take much longer. During final drilling, a hardening or non-hardening slurry may be injected through the auger and into the soil. The hardening slurry is consolidated with the soil by soil mixing paddles 18. When a hardening slurry is injected into soil and mixed, the process is referred to as "structural consolidation" because the soil-cement structure is being cast in this step.

A chemical hardener in the hardening slurry mixes with the soil to form the soil-cement structure. The term "chemical hardener" includes any chemicals and agents that can be added and mixed with soil to cause chemical reactions. Examples of chemicals and agents are: portland cement, lime, fly ash, kiln dust, cement-based hardeners, bitumen, resin, power plant residues, bentonite, salts, acids, sodium and calcium silicates, calcium aluminates, and sulfates. The chemical reactions include pozzolanic reaction (cementation), hydration, ion-exchange, polymerization, oxidation, and carbonation. The results of these chemical reactions include changes in the physical properties of soil such as strength and permeability and/or the change of chemical properties such as the reduction of the toxicity level in contaminated soil or sludge.

When a non-hardening slurry is injected, this step is considered "non-structural consolidation" because, although the bore hole is being prepared for the soil-cement structure, the structure is not being cast when a non-hardening slurry is injected.

The use of the term "final drilling" does not necessarily mean that it is the last drilling that will be done in the bore hole. Rather, it is intended to indicate the last drilling directed specifically to the construction of a particular soil-cement column. When a soil-cement structure is being constructed, a particular soil-cement column may be drilled through again to form a continuous wall after final drilling is complete.

Upward drilling is accomplished in a similar manner with the direction of movement of the auger blades being reversed. If a hardening or non-hardening slurry is to be used during upward drilling the hardening slurry can be injected through the auger.

When preparatory drilling is used in conjunction with final drilling there are various combinations of steps which will result in a prolonged period of time during which the auger can operate in the bore hole. By way of example and not limitation, consolidating soil and lubricating slurry during both downward and upward preparatory drilling may be followed by structural consolidation during both downward and upward final drilling. In another example, non-structural consolidation during downward final drilling and structural consolidation during upward final drilling, or fracturing during downward final drilling and structural consolidation during upward final drilling might be utilized.

Alternatively, fracturing of the soil during downward and upward preparatory drilling may be followed by structural consolidation during both downward and upward final drilling. Furthermore, non-structural consolidation during downward final drilling and structural consolidation during upward final drilling, or fracturing during downward final drilling and structural consolidation during upward final drilling could be utilized.

It will be appreciated that a number of other combinations of these techniques may be used to prolong the length of time in which the auger can operate on the bore-hole before operation of the auger is effected by hardening of the soil-cement mixture.

The hardening slurry which may be used in downward or upward drilling may include chemical hardener, clay and liquid. Many additional constituents or admixtures may also be utilized to customize the slurry to the specific soil conditions or to create special characteristics in the finished soil cement column. In a presently preferred embodiment of the invention, the hardening slurry includes cementitious material, bentonite and water. By way of example and not limitation, the following hardening slurries may be used: (a) in clay, silt or sand: 200–250 kilograms of cementitious material, 7 kilograms of bentonite, and 250–300 kilograms of water; or (b) in coarse sand, sandy gravel, or soft rock: 200–250 kilograms of cementitious material, 7 kilograms of bentonite, and 200–250 kilograms of water.

The non-hardening slurry which may be used in downward drilling may include aggregate, clay and water. In a presently preferred embodiment of the invention, the non-hardening slurry includes slag, bentonite, and water. By way of example and not limitation, the following non-hardening slurries may be used: (a) in clay, silt, or sand: 100–150 kilograms of slag, 20–30 kilograms of bentonite, 450–650 kilograms of water; or (b) in coarse sand, sandy gravel, or soft rock: 70–200 kilograms of slag, 18 kilograms of bentonite, and 350–370 kilograms of water.

What is claimed and desired to be secured by United States Patent is:

1. A method for creating an in situ mixture of a slurry with soil as an auger penetrates the soil, the mixture intended for use in producing soil-cement structures, the method comprising the steps of:

a) drilling downward through soil with an auger;

b) injecting downwardly through the tip of the auger a non-hardening slurry into the soil during the downward drilling to nonstructurally consolidate the non-hardening slurry with the soil, to thereby reduce the friction between the fractured soil, the auger, and soil adjacent to the auger;

c) drilling upward to remove the auger from the soil; and d) injecting into the soil through the auger a hardening slurry during the upward drilling of the auger to structurally consolidate the soil and the slurry.

2. A method as recited in claim 1, wherein the step of injecting a nonhardening slurry into the soil comprises the step of injecting a nonhardening slurry comprised of aggregate, clay, and a liquid.

3. A method as recited in claim 2, wherein the slurry is comprised of slag, bentonite and water.

4. A method as recited in claim 1, wherein the step of injecting a hardening slurry into the soil comprises the step of injecting a hardening slurry comprising a chemical hardener, clay, and a liquid.

5. A method as cited in claim 4, wherein the hardening slurry comprises portland cement, bentonite and water.

6. A method as recited in claim 1, further comprising the steps of:

a) predrilling downward through soil; and b) the step of predrilling upward through the soil.

7. A method as recited in claim 6, wherein the step of predrilling downward through soil further comprises the step of consolidating a nonhardening slurry with the soil.

8. A method as recited in claim 6, wherein the step of predrilling upward through the soil further comprises the step of consolidating a nonhardening slurry with the soil.

9. A method as recited in claim 6, wherein the steps of predrilling downward through the soil and predrilling upward through the soil both further comprise consolidating a nonhardening slurry with the soil.

10. A method for the creation of an in situ mixture of a slurry with soil as an auger penetrates the soil, the mixture intended for use in producing soil-cement structures, the method comprising the steps of:

a) fracturing soil with an auger in a downward direction;

b) fracturing soil with an auger in an upward direction;

c) drilling downward through soil with an auger;

d) injecting into the fractured soil, through the auger, a hardening slurry during the downward drilling;

e) drilling upward to remove the auger from the soil; and f) injecting into the fractured soil, through the auger, a hardening slurry during the upward drilling of the auger to structurally consolidate the soil and the slurry.

11. A method as recited in claim 10, wherein the step of injecting a hardening slurry further comprises the step of injecting a hardening slurry comprised of a chemical hardener, clay, and a liquid.

12. A method as cited in claim 10, wherein the hardening slurry comprises portland cement, bentonite and water.

* * * * *